United States Patent [19]

Okazaki et al.

[11] 4,125,921

[45] Nov. 21, 1978

[54] APPARATUS FOR GAS-SINGEING KNITTED FABRICS

[75] Inventors: Narukazu Okazaki; Hiroshi Azuma, both of Wakayama, Japan

[73] Assignee: Wakayama Iron Works, Ltd., Wakayama, Japan

[21] Appl. No.: 803,316

[22] Filed: Jun. 3, 1977

[51] Int. Cl.[2] ..... D06C 9/02

[52] U.S. Cl. ..... 26/3

[58] Field of Search ..... 26/3, ; 28/174, 239; 34/110, 122, 115; 432/59

[56] References Cited

U.S. PATENT DOCUMENTS

| | | | |
|---|---|---|---|
| 3,448,498 | 6/1969 | Sando et al. | 26/3 |

FOREIGN PATENT DOCUMENTS

| | | | |
|---|---|---|---|
| 399,614 | 8/1924 | Fed. Rep. of Germany | 26/3 |
| 2,130,139 | 12/1972 | Fed. Rep. of Germany | 26/3 |
| 454,417 | 2/1970 | Japan | 26/3 |
| 5,037,795 | 12/1975 | Japan | 26/3 |
| 29,969 of | 1896 | United Kingdom | 26/3 |
| 1,358,479 | 7/1974 | United Kingdom | 26/3 |

OTHER PUBLICATIONS

Machinery: What's New, Textile Month, p. 68, June, 1974.

*Primary Examiner*—Robert R. Mackey

*Attorney, Agent, or Firm*—Armstrong, Nikaido, Marmelstein & Kubovcik

[57] ABSTRACT

An apparatus for uniformly gassingeing knitted fabrics in tensionless condition while preventing the curling of the selvages.

6 Claims, 6 Drawing Figures

APPARATUS FOR GAS-SINGEING KNITTED FABRICS

BACKGROUND OF THE INVENTION (a) Field of the Invention

The present invention relates to a gas-singeing apparatus which permits blowing flames against both surfaces of an open knitted fabric to burn off the useless naps or fluffs so as to improve the quality of the knitted fabric.

Generally, the open knitted fabrics are highly stretchable and tend to have curls on their selvages. The higher a tension applied to the knitted fabric, the more the fabric stretches and hence its width decreases, not only losing the normalcy of the stitches but also causing the selvages to curl more easily.

(b) Description of the Prior Art

Conventionally, an open knitted fabric introduced into entrance guide rolls is expanded by an expander, such as a tricot guider, and then passed in an S-curve around two suction rolls in a gas-singeing section, where the naps or fluffs on both surfaces of the knitted fabric are burnt off.

The above mentioned suction rollers serve to move the knitted fabric while sucking and holding the same. If the knitted fabric has wrinkles or curls on its selvages left while passing around the suction rollers, satisfactory gas-singeing cannot be attained, causing unevenness of treatment to be introduced into the subsequent processes including dyeing.

The conventional apparatus has a disadvantage that new curls tend to be produced again on the selvages of the open knitted fabric in a course from the expander to the suction rollers.

Further, the conventional suction roller is in the form of a cylinder having a number of perforated small holes in the peripheral surface and one end thereof is connected to a suction producing device. Therefore, the suction force acting on the small holes of the roller tends to be nonuniform longitudinally of the roller. As a result, the holding of the knit fabric by suction becomes nonuniform widthwise of the fabric, so that at the end where the suction force is weak, wrinkles and curls are liable to be produced, forming a cause of unevenness of the singeing effect.

Further, conventionally, the knitted fabric is sucked directly onto the peripheral surface of the suction roller, so that flames pass through the fabric only at places where the small holes exist while at places between small holes the flames cannot pass through the fabric, thus producing unevenness of the singeing effect.

Further, the conventional gas burner is designed so that only the angle of the flame jet can be adjusted.

Only the adjustment of the angle of the flame jet is not effective enough for setting the optimum singeing conditions and said design is inconvenient when it is necessary to adjust the distance between the gas burner and the suction roller in accordance with flames in an optimum condition.

SUMMARY OF THE INVENTION

According to the invention, a selvage stretching device such as a selvage uncurler is provided just upstream of suction rolls so that the open knitted fabric may be fed from a guide roll to a suction roll via an expander and a feed roll in an expanded condition with its selvages positively stretched.

Further, according to the invention, means are provided inside the suction roll for uniforming the suction effect, thereby uniformly sucking and holding the knitted fabric.

Further, according to the invention, a net or wire net is installed around the outer peripheral surface of the suction roller to produce a uniform suction effect throughout the surface, assuring that flames will pass uniformly through the stitches of the knitted fabric, thereby preventing uneveness of gas-singeing effects.

Further, according to the invention, gas burners are adapted to be moved toward and away from the suction rollers while allowing adjustment of the angle of the flame jet, and these adjusting operations can be independently carried out.

In the manner described above, the invention provides a satisfactory apparatus for uniformly singeing the knitted fabrics in tensionless condition with the curling of the selvages prevented.

DESCRIPTION OF THE PREFERRED EMBODIMENT

Figure 1:
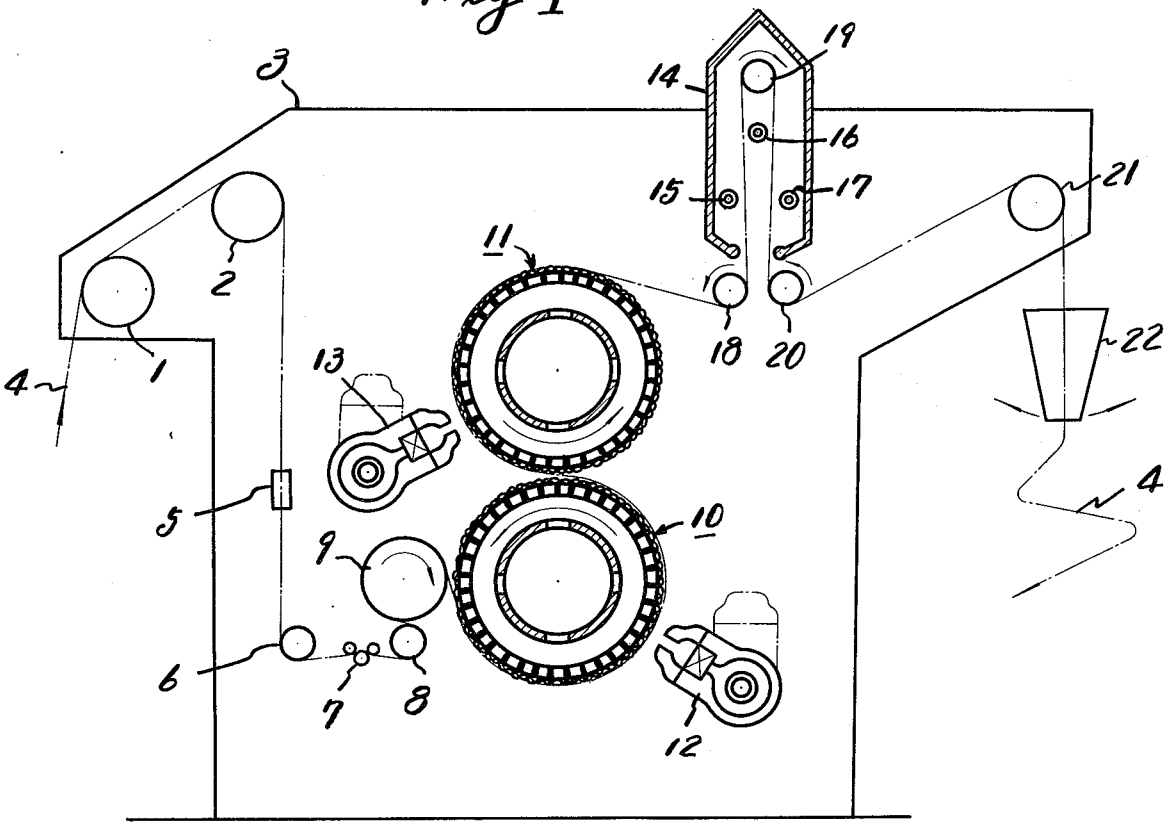
FIG. 1 is a schematic side view in longitudinal section of an apparatus according to the invention.

In FIG. 1, the numerals 1 and 2 designate guide rollers for a knitted fabric 4 installed at the entrance to a machine frame 3; 5, a tricot guider; 6, a guide roller; 7, a selvage uncurler; 8, a guide roller; 9, a feed roller; 10, a first suction roller; 11, a second suction roller; 12 and 13, gas burners respectively associated with the suction rollers 10 and 11; and the numeral 14 designates a residual-fire extinguisher device box having steam blowing pipes 15, 16 and 17 installed therein. Thus, the knitted fabric 4 is introduced via guide rollers 18, 19 and 20 into the box through a lower opening in the box 14, turns back at the top of the box 14 and is then guided to a guide roller 21 at the exit from the box and then to a folder 22, whereby the knitted fabric is folded onto a conveyor (not shown) or a container (not shown).

The two suction rollers 10 and 11 are disposed in a vertical row on the machine frame 3, the first suction roller 10 being disposed below.

Disposed adjacent or in contact with the front side of the first suction roller 10 is the feed roller 9, disposed adjacent or in contact with the lower side of the feed roller 9 is the guide roller 8, and disposed adjacent or in contact with the guide roller 8 is the selvage uncurler 7.

The guide rollers 1 and 2 at the entrance to the machine frame 3 are disposed in the upper region of the machine frame 3 and the knitted fabric 4 is guided substantially vertically to the guide roller 6 disposed in the lower region of the machine frame 3 and subjected to an expanding action from the tricot guider 5 disposed therebetween.

Thus, the knitted fabric 4 is guided from a supply box (not shown) to the guide rollers 1 and 2, but if it is fed directly to the first suction roller 10, this means that it would be fed thereto together with its wrinkles and curls. To avoid this, the tricot guider expands the knitted fabric.

Structural restrictions on the tricot guider 5 make it impossible to position the tricot guider close to the first suction roller 10. Therefore, the knitted fabric 4 expanded by the tricot guider 5 tends to have curls produced again on its selvages on the way to the first suction roller 10. For this reason, the selvages are spread just upstream of the first suction roller 10, and in this condition the knitted fabric is fed to the first suction roller 10 to make satisfactory singeing possible.

Since the path of travel of the knitted fabric 4 from the selvage uncurler 7 to the first suction roller 10 via the guide roller 8 and feed roller 9 is zigzag, the selvages are prevented from curling.

The feed roller 9 is positively driven in the direction of the arrow by a drive (not shown) and overfeeding is made possible in order to feed the knitted fabric 4 to the first suction roller 10 in tensionless condition.

The first and second suction rollers 10 and 11 are positively driven in the directions of the arrows shown in FIG. 1 at the same peripheral speed by a drive (not shown).

As for the relation between the peripheral speeds of the feed roller 9 and the first and second suction rollers 10, 11, their peripheral speeds are equal or the peripheral speed of the feed roller 9 is slightly higher, in order to move the knitted fabric in a tensionless condition.

Figure 2:
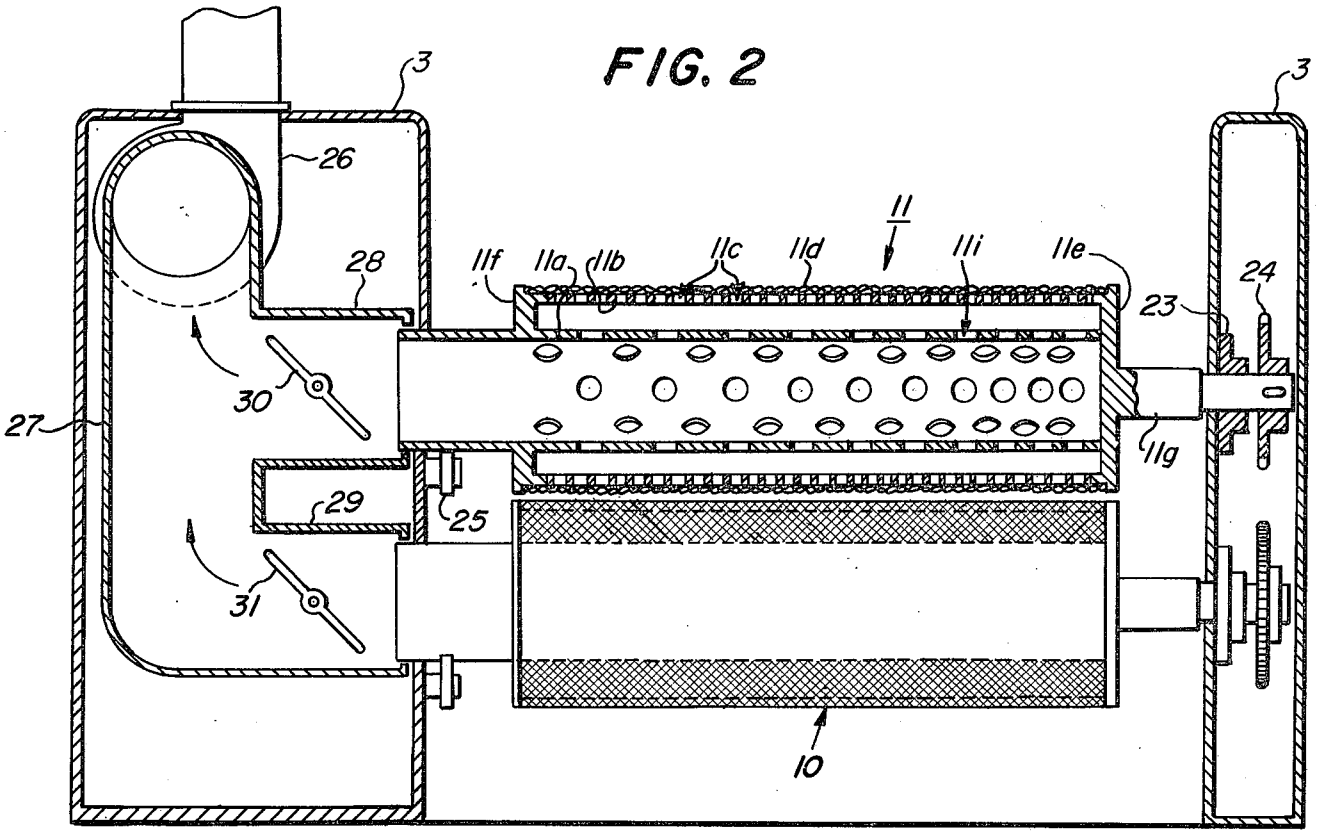
FIG. 2 is a schematic front view in longitudinal section of suction rollers of the same.

The construction of the first and second suction rollers 10 and 11 is shown in FIG. 2. These two rollers 10 and 11 have the same construction, and the internal construction of one of the suction rollers will be described. FIG. 2 shows the internal construction of the second suction roller 11. The second suction roller 11 comprises concentric inner and outer barrels **11*a* and 11*b*, said outer barrel 11*b* having a number of small air-permeable holes formed in the peripheral surface thereof and a net or wire net 11*d*** wrapped around the outer peripheral surface thereof to provide air permeability throughout the surface.

The inner and outer barrels **11*a* and 11*b* are joined together by end plates 11*e* and 11*f*, one end plate 11*e* being blind and having a shaft 11*g* projecting from the center of the lateral surface thereof, said shaft 11*g* being rotatably supported by the machine frame 3 through a bearing 23 and having a driving gear 24** secured to its end.

The other end plate **11*f* is annular and cooperates with the inner barrel 11*a* to define an annular space whose end is closed. The inner barrel 11*a* extends beyond said end plate 11*f* and is rotatably supported on a plurality of rollers 25 carried by the machine frame 3**.

Figure 6:
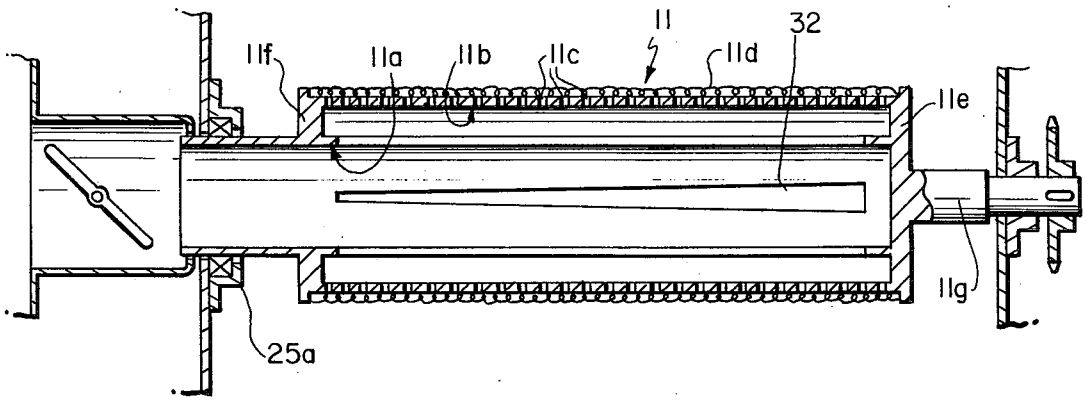
FIG. 6 is a longitudinal section of an alternative embodiment of a suction roller according to the present invention.

The bearing construction of the extended end of said inner barrel **11*a* is not limited to a plurality of rollers 25. For example, a roller bearing or ball 25*a* bearing may be used as shown in FIG. 6**.

The extended end of said inner barrel **11*a* is associated with a suction producing device 26 installed in the machine frame 3. The suction producing device 26 may be one of various types, but a blower is shown in FIG. 2**.

The suction producing device 26 has a suction duct 27 connected thereto which has branch ducts 28 and 29 to exert suction in the first and second suction rollers. The open ends of the branch ducts 28 and 29 communicate with the open ends of the first and second suction rollers 10 and 11. In addition, suction adjusting dampers 30 and 31 are installed in the branch ducts 28 and 29, and they are adjustable by handles (not shown).

The inner barrel **11*a* has a suction distributing function which assures that suction acts uniformly throughout the length of the second suction roller 11, and FIG. 2 illustrates a case where a number of ventilating holes 11*i* arranged with varying density such that the density increases as the distance from the suction duct 27** increases.

The function required of the innner barrel **11*a* is to enable suction to act uniformly, and such construction is not limited to the ventilating holes 11*i* shown in FIG. 2. For example, it is possible to use slits 32 each having an opening area which increases as the distance from the suction duct 27** increases.

The detailed construction of the first suction roller 10 is the same as that of the second sucond suction roller 11 described above, and hence a description thereof will be omitted.

Gas burners 12 and 13 are associated with said first and second suction rollers 10 and 11. Since these gas burners have the same construction, only one of them will be described with reference to FIGS. 3–5.

Figure 3:
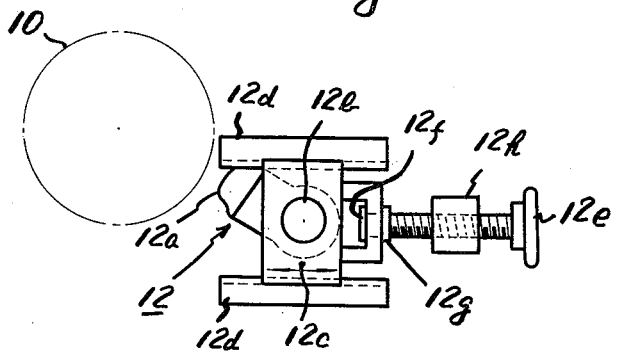
FIG. 3 is a schematic side view of a gas burner distance adjusting mechanism of the same.
Figure 4:
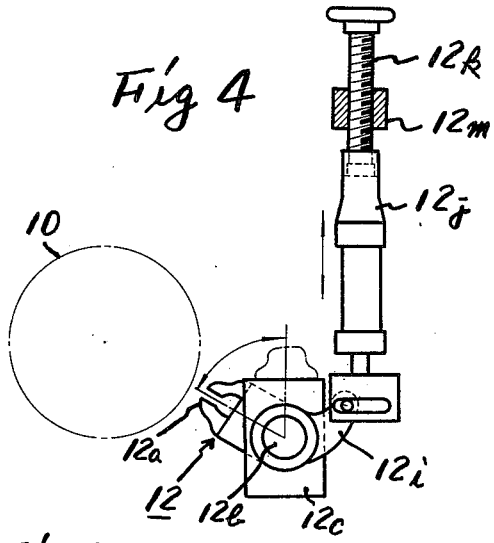
FIG. 4 is a schematic side view of a gas burner angle adjusting mechanism of the same.
Figure 5:
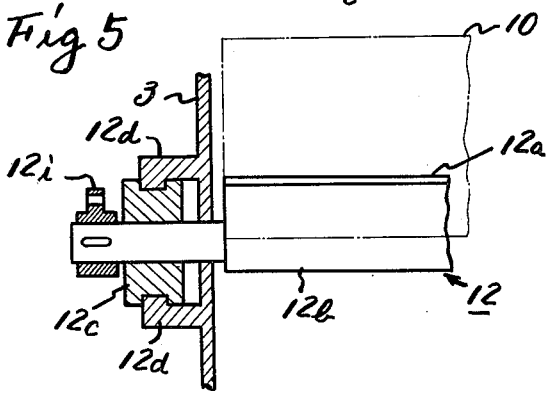
FIG. 5 is a schematic front view in longitudinal section of a gas burner end supporting mechanism of the same.

FIGS. 3–5 show the burner 12 associated with the first suction roller 10. The gas burner 12 has a slit type nozzle **12*a* which opens throughout the length of the first suction roller 10 and whose base portion is connected to a gas pipe 12*b*. One end of the gas pipe 12*b* is connected to a gas supply source (not shown) and the other end is closed. Both ends of the gas pipe 12*b* are of the same construction and supported by the machine frame 3**, but the support construction of one end alone is illustrated.

Thus, the end of the gas pipe **12*b* is slidably supported in a slide block 12*c* which is slidably supported by guide rails 12*d*, 12*d* provided on the machine frame 3. The direction of slide of the slide block 12*c* is such as to allow the slide block to move toward and away from the first suction roller 10. That is, the direction is such as to allow the nozzle 12*a* to move linearly with respect to the first suction roller 10**.

An operating handle **12*e* for linearly moving the nozzle 12*a*, as shown in FIG. 3, has its front end rotatably connected to the slide block 12*c* by hoops 12*f* and 12*g***.

The operating handle **12*e* has a threaded portion which is screwed into a threaded block 12*h* fixed to the machine frame 3**.

The end of the gas pipe **12*b* has an angle adjusting lever 12*i* fixed thereto, as shown in FIGS. 4 and 5, and one end of an extensible link member 12*j* is connected to said lever 12*i*, as shown in FIG. 4**.

The other end of said link member **12*j* is engaged with an angle adjusting handle 12*k***.

The operation handle **12*k* has a threaded portion which is screwed into a threaded block 12*m* fixed to the machine frame 3**.

The operating handle **12*k* and the link member 12*j* are engaged with each other in such a manner as not to interfere with the slide movement of the slide block 12*c*, the arrangement being such that the angle of the flame jet from the nozzle 12*a* can be adjusted with respect to the first suction roller 10 by rotating the operating handle 12*k***.

The gas burner 13 associated with the second suction roller 11 has a similar support construction, and a description thereof will be omitted.

The way the knitted fabric 4 is gas-singed by the apparatus of the present invention is as follows.

The distances and angles of the gas burners 12, 13 with respect to the suction rollers 10, 11 are adjusted to the optimum values in accordance with the nature of the knitted fabric 4 and desired gas-singeing conditions. The knitted fabric is then entrained in the manner shown in FIG. 1 and the operation is started.

The knitted fabric 4 is passed around the guide rollers 1 and 2 at the entrance to the machine frame 3 and is expanded by the tricot guider 5. Just upstream of the first suction roller 10, it has its selvages spread by the selvage uncurler 7 and then it is fed from the feed roller 9 to the first suction roller 10 in tensionless and spread condition. Since the first suction roller 10 has suction acting throughout the length thereof, it sucks and holds the knitted fabric 4 with a uniform suction force. Therefore, the knit fabric 4 sucked by the first suction roller 10 is held with the stitches in normal condition having no wrinkles or curls on the selvages and it is conveyed to the gas burner 12 by the rotation of the first suction roller 10.

One surface of the knitted fabric 4 is singed by the gas burner 12. In this case, since the first suction roller 10 has the net or wire net wrapped around the outer peripheral surface, the knitted fabric 4 is sucked and held in such a manner that it is somewhat lifted from the outer peripheral surface of the outer barrel of the first suction roller 10. As a result, the flames from the gas burner 12 are drawn uniformly not only to the perforated holes of the outer barrel but also to the entire surface and hence they pass uniformly through the stitches of the knitted fabric to perform the singeing.

At the second suction roller 11, the opposite side of the knitted fabric 4 is singed in the same manner.

Therefore, the knitted fabric 4 is singed over all its surfaces, including the selvages, uniformly in tensionless and spread condition, so that no troubles will be caused in the subsequent treatments.

The knitted fabric 4 singed at the second suction roller 11 by the gas burner 13 is introduced into the residual-fire extinguishing box 14, where an oxygen-deficient condition is established by steam blown in from the steam blowing pipes 15, 16 and 17, whereby the residual fire on both surfaces is completely put out and a suitable amount of moisture is imparted thereto. The knitted fabric is then received in a container or the like (not shown) via the guide roller 21 and the folder 22. In addition, the folder 22 is oscillated in accordance with the speed at which the fabric 4 is being delivered.

As has been described so far, according to the apparatus of the present invention, it is possible to feed the open knitted fabric to the singeing sections in such a manner that the knit fabric is maintained, in tensionless and expanded condition over the entire surfaces including the selvages while the singeing is carried out. Moreover, cooperation between the uniform ventilating function throughout the surfaces and the uniform suction distributing function provided by the nets or wire nets on the outer surfaces of the suction rollers assures uniform singeing of the knitted fabric by the gas burners. Further, each gas burner is adapted so that its distance and angle of flame jet with respect to the suction roller can be independently adjusted. Therefore, the gas-singeing conditions for the knitted fabrics can be controlled to the optimum.

Accordingly, with the apparatus of the present invention, it is possible to carry out singeing of the knitted fabrics better than with any conventional gas-singeing apparatus.

While there have been described herein what are at present considered preferred embodiments of the several features of the invention, it will be obvious to those skilled in the art that modifications and changes may be made without departing from the essence of the invention.

It is therefore to be understood that exemplary embodiments thereof are illustrative and not restrictive of the invention, the scope of which is defined in the appended claims and that all modifications that come within the meaning and range of equivalency of the claims are intended to be included therein.

We claim:

1. An apparatus for gas-singeing knitted fabrics, comprising a feeding section including expanding means and selvage spreading means for feeding a knitted fabric to a singeing section in a tensionless and expanded condition; suction means for creating a suction; two suction roller means for allowing the knitted fabric to travel in an S-curve in a tensionless and expanded condition, each of the suction roller means comprising an inner barrel coupled at one end thereof to the suction means, the inner barrel including uniform suction distributing means having a density which increases as a function of the distance from the one end of the inner barrel, an outer barrel surrounding the inner barrel and coaxial therewith, with an annular space therebetween, the outer barrel including a plurality of small holes therethrough, and mesh means wrapped around the outer surface of the outer barrel; two gas burners associated with the suction roller means and including a singeing condition adjusting mechanism, wherein both surfaces of the knitted fabric moved in an S-curve by the two suction roller means are alternately gas-singed throughout the width thereof; and means for extinguishing the residual fire on the knitted fabric after singeing.

2. An apparatus for gas-singeing knitted fabrics as set forth in claim 1, wherein the selvage spreading means is disposed downstream of the expanding means and just upstream of the first of the two suction rollers means.

3. An apparatus for gas-singeing knitted fabrics as set forth in claim 1, wherein each of the two gas burners associated with the two suction roller means includes a distance adjusting mechanism and a jet angle adjusting mechanism with respect to the associated suction roller means, said mechanisms being independently adjustable.

4. An apparatus for gas singeing knitted fabrics as set forth in claim 1 wherein the uniform suction distributing means comprises a plurality of holes in the inner barrel, the density of the holes increasing as the distance from the one end increases.

5. An apparatus for gas singeing knitted fabrics as set forth in claim 1 wherein the uniform suction distributing means comprises a plurality of slits in the inner barrel wherein the width of the slit increases as the distance from the one end increases.

6. An apparatus for gas singeing as set forth in claim 1 wherein the mesh means comprises a wire net wrapped around the outer barrel.

* * * * *